United States Patent [19]

Perkins

[11] 4,027,700

[45] June 7, 1977

[54] REVERSING VALVE CONSTRUCTION

[75] Inventor: Charles H. Perkins, Newtown Square, Pa.

[73] Assignee: Robertshaw Controls Company, Richmond, Va.

[22] Filed: Apr. 1, 1976

[21] Appl. No.: 672,607

[52] U.S. Cl. ..... 137/625.66; 137/625.27; 137/625.43

[51] Int. Cl.[2] ..... F16K 11/00

[58] Field of Search ..... 137/596.18, 625.27, 137/625.43, 625.66, 625.5

[56] References Cited

UNITED STATES PATENTS

| | | | |
|---|---|---|---|
| 2,372,311 | 3/1945 | Brown | 137/625.43 X |
| 3,608,587 | 9/1971 | Zbell | 137/625.27 X |

FOREIGN PATENTS OR APPLICATIONS

| | | | |
|---|---|---|---|
| 1,252,027 | 10/1967 | Germany | 137/625.27 |
| 2,337,007 | 6/1975 | Germany | 137/625.5 |
| 521,663 | 3/1955 | Italy | 137/625.27 |
| 1,224,241 | 3/1971 | United Kingdom | 137/625.27 |

*Primary Examiner*—Robert G. Nilson
*Attorney, Agent, or Firm*—Candor, Candor & Tassone

[57] ABSTRACT

A reversing valve construction having a housing provided with four aligned valve seats and a first movable valve member disposed between the two intermediate valve seats. Second and third movable valve members are respectively disposed outboard of the outboard valve seats. A first pneumatically operated movable part is carried by the housing and is operatively associated with the first and second valve members for sequentially moving the same to close one of the two intermediate valve seats and one of the outboard valve seats when the first part is moved in one direction a certain amount. A second pneumatically operated movable part is carried by the housing and is operatively associated with the first and third valve members for sequentially moving the same to close the other of the two intermediate valve seats and the other of the two outboard valve seats when the second part is moved in a direction opposite to the one direction a certain amount.

7 Claims, 3 Drawing Figures

COOLING

HEATING

REVERSING VALVE CONSTRUCTION

This invention relates to an improved reversing valve construction.

It is well known that one major problem of four-way reversing valves for refrigerant systems is the resultant inefficiency due to internal leakage of the valves. Present reversing valves use a sliding valve seal in which the seal is achieved either by tightness of fit between the piston valve and cylinder or by the fit between a flat valve surface and a sliding valve member. It is believed that the piston and cylinder valve will inherently leak and the leakage of the sliding valve depends upon the flatness of the mating surfaces.

Thus, it is desired to provide a four-way reversing valve that achieves tight sealing of the ports so that the refrigerant system inefficiency due to internal leakage is minimized.

Accordingly, it is a feature of this invention to provide a reversing valve construction wherein tight sealing of the ports is achieved to minimize internal leakage.

In particular, one embodiment of this invention provides a reversing valve construction having a housing means provided with a pair of valve seats and a pair of valve members respectively for opening and closing the valve seats. A single pneumatically operated movable part is carried by the housing means and is operatively associated with the valve members for sequentially moving the same to their closed positions against the respective valve seats when the movable part is moved in one direction a certain amount. In this manner, the sequential closing of the valve seats eliminates the need for manufacturing tolerances which prevent both valve members from closing at the same time as in the prior art.

Accordingly, it is an object of this invention to provide an improved reversing valve construction having one or more of the novel features set forth above or hereinafter shown or described.

Other objects, uses and advantages of this invention are apparent from a reading of this description which proceeds with reference to the accompanying drawings forming a part thereof and wherein.

Figure 1:
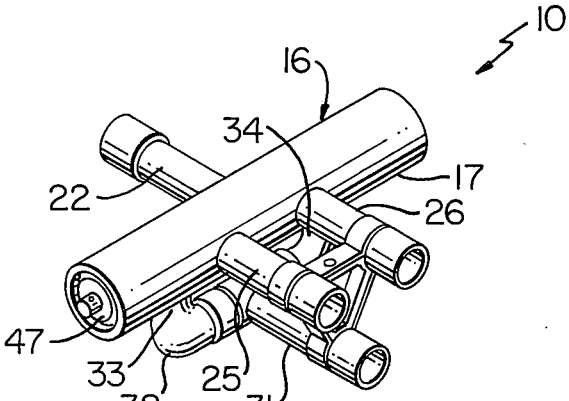
FIG. 1 is a perspective view illustrating the improved reversing valve construction of this invention.

While the various features of this invention are hereinafter described and illustrated as being particularly adapted to provide a reversing valve construction for a refrigerant system, it is to be understood that the various features of this invention can be utilized singly or in any combination thereof to provide a reversing valve construction for other systems as desired.

Therefore, this invention is not to be limited to only the embodiment illustrated in the drawings, because the drawings are merely utilized to illustrate one of the wide variety of uses of this invention.

Figure 2:
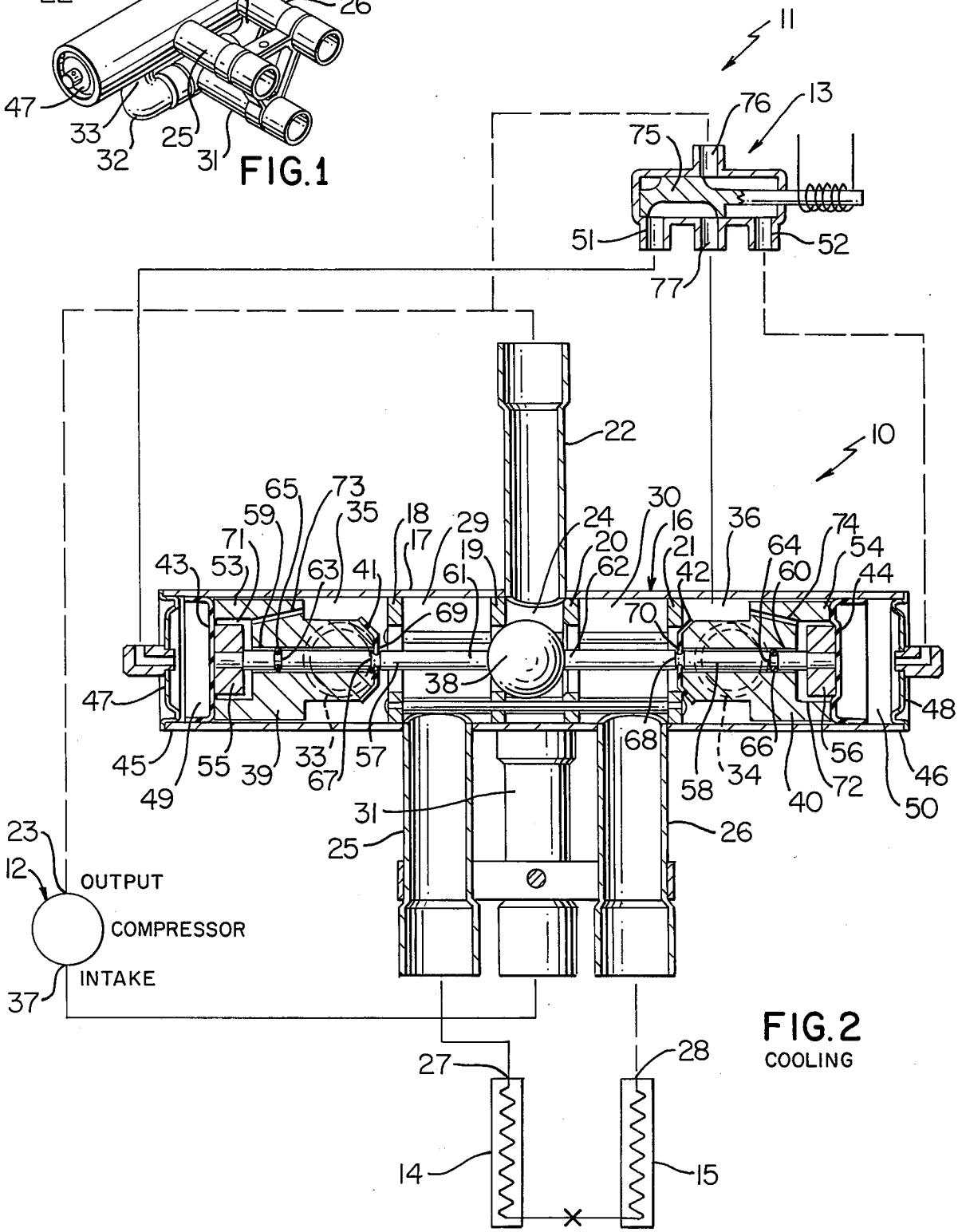
FIG. 2 is an enlarged cross-sectional view taken on line 2—2 of FIG. 1 and illustrates the reversing valve construction of FIG. 1 in a refrigerant system that is set for the cooling mode thereof.
Figure 3:
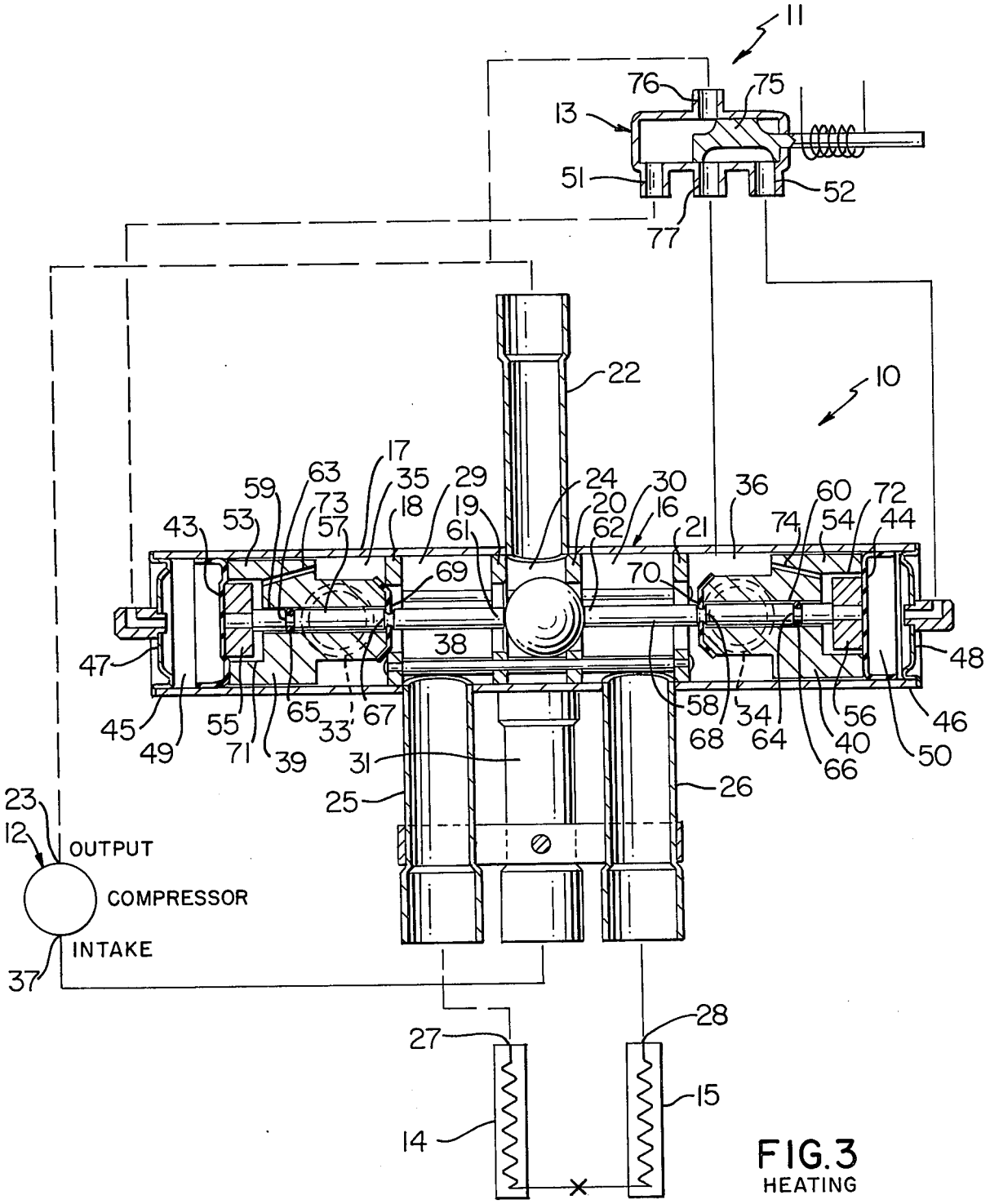
FIG. 3 is a view similar to FIG. 2 and illustrates the reversing valve construction and the refrigerant system when set for the heating mode thereof.

Referring now to FIGS. 1 and 2, the improved reversing valve construction of this invention is generally indicated by the reference numeral 10 and is illustrated in FIGS. 2 and 3 as being utilized in a refrigerant system that is generally indicated by the reference numeral 11 and comprising a refrigerant compressor 12, a solenoid operated pilot valve construction 13, an inside refrigerant coil 14 and an outside refrigerant coil 15, the inside coil 14 being utilized to cool a building containing the same when the system 11 is set for the cooling mode of FIG. 2 and is utilized to heat the building when the system 11 is set for the heating mode thereof as illustrated in FIG. 3 in a manner well known in the art.

The reversing valve construction 10 of this invention comprises a housing means 16 which in the embodiment illustrated in the drawings comprises a plurality of tubular parts suitably secured together, the housing means 16 comprising a main cylindrical tubular part 17 having four washer-like valve seats 18, 19, 20 and 21 arranged therein in spaced aligned relation and suitably fastened thereto for a purpose hereinafter described.

A first tubular member 22 is transversely interconnected to the housing part 17 so as to fluidly interconnect the output side 23 of the refrigerant compressor 12 to a chamber 24 of the housing means 16 defined between the two intermediate valve seats 19 and 20. Similarly, a pair of tubular members 25 and 26 are also transversely interconnected to the main tubular member 17 of the housing means 16 so as to respectively interconnect one side 27 and 28 of the coils 14 and 15 respectively to chambers 29 and 30 of the housing means 16, the chamber 29 being disposed between the valve seats 18 and 19 and the chamber 30 being disposed between the valve seats 20 and 21.

Another tubular member 31 is fluidly interconnected to a branch tubular member 32, FIG. 1, that has its opposed ends 33 and 34 respectively disposed in fluid communication with a pair of chambers 35 and 36 of the housing means 16 respectively disposed outboard of the outboard valve seats 18 and 21 as illustrated to interconnect the intake side 37 of the compressor 12 to the chambers 35 and 36 for a purpose hereinafter described.

A ball valve member 38 is disposed in the chamber 24 between the intermediate valve seats 19 and 20 to respectively open one of the valve seats 19 or 20 while closing the other of the valve seats 20 or 19 depending upon its axial position in the chamber 24 as illustrated in FIGS. 2 and 3.

A pair of valve members 39 and 40 are disposed in the chambers 35 and 36 and respectively have resilient end parts 41 and 42 for respectively opening and closing the outboard valve seats 18 and 21 depending upon the axial positions of the valve members 39 and 40 relative thereto as illustrated in FIGS. 2 and 3.

A pair of axially movable, cup-shaped flexible diaphragms 43 and 44 are respectively disposed in the opposed ends 45 and 46 of the tubular member 17 to sealingly slide therein and respectively cooperate with end caps 47 and 48 that respectively close the open ends 45 and 46 of the tubular member 17 to define end chambers 49 and 50 respectively fluidly interconnected to ports 51 and 52 of the pilot valve construction 13 for a purpose hereinafter described.

The valve members 39 and 40 respectively have tubular end piston portions 53 and 54 respectively disposed in engagement with the flexible diaphragms 43 and 44 to be moved thereby in a manner hereinafter described.

In addition, piston potions 55 and 56 of a pair of push rods 57 and 58 respectively pass through central bores 59 and 60 of the valve members 39 and 40 and engage against the flexible diaphragms 43 and 44 while the push rods 57 and 58 respectively project through the outboard valve seats 18 and 21 and have ends 61 and 62 respectively adapted to engage against the ball valve member 38 for a purpose hereinafter described.

The push rods 57 and 58 respectively have annular grooves 63 and 64 therein respectively receiving annular sealing means 65 and 66 for sealing the push rods 57 and 58 in the bores 59 and 60 of the valve members 39 and 40 while permitting axial movement relative thereto, the push rods 57 and 58 also having other annular grooves 67 and 68 therein to receive the inner peripherial means 69 and 70 of the resilient parts 41 and 42 of the valve members 39 and 40 to assist in sealing the bores 59 and 60 from the valve seats 18 and 21 as will be apparent hereinafter.

The resulting spaces or areas 71 and 72 between the piston parts 53, 55 and 54, 56 are respectively fluidly interconnected to the chambers 35 and 36 by cross-passages 73 and 74 respectively formed in the valve members 39 and 40 to relieve the spaces 71 and 72 from a dash pot effect thereof during relative movement of the piston portions 53, 55 and 54, 56 as will be apparent hereinafter.

From the above, it can be seen that the reversing valve construction 10 of this invention can be formed from relatively simple parts adapted to be economically assembled together to produce the reversing valve construction 10 which operates in a manner now to be described.

With the valve member 75 of the pilot valve construction 13 disposed in the position illustrated in FIG. 2 wherein an inlet port 76 is fluidly interconnected to the port 52 and the port 51 is fluidly interconnected to another port 77 as illustrated, the system 11 will be set in its cooling mode because output pressure of the compressor is feed by the port 76 of the pilot valve construction 13 to the port 52, and, thus, to the chamber 50 of the reversing valve construction 10 to drive the flexible diaphragm 44 to the left in FIG. 2 and through the piston portion 56 cause the ball valve member 38 to close against the valve seat 19 while opening the valve seat 20. In this manner, the output pressure from the compressor 12 passes from the intermediate chamber 24 of the reversing valve construction 10 through the open valve seat 20 and outlet member 26 to the coil 15 whereby the compressed refrigerant will expand in the coil 14 in a manner well known in the art to provide cooling for the building containing the coil 14, the output from the coil 14 passing through the tubular member 25, chamber 29, open valve seat 18 and chamber 35 into the return tubular members 32 and 31 to the intake side 37 of the compressor 12.

The movement of the flexible diaphragm 44 to the left in FIG. 2 also, through the piston portion 54 of the valve member 40, causes the valve member 40 to close the valve seat 21 so that the chamber 30 will not be interconnected to the chamber 36 and, thus, to the return conduits 32 and 31.

However, when the valve member 75 of the pilot valve construction 13 is moved to the right in the manner illustrated in FIG. 3 so that the valve member 75 fluidly interconnects the ports 77 and 52 together as well as fluidly interconnects the ports 51 and 76 together, it can be seen that the output pressure of the compressor 12 is now directed to the left hand chamber 49 of the valve construction 10 to operate on the flexible diaphragm 43 to move the diaphragm 43 to the right as illustrated in FIG. 3 and act on the piston portions 53 and 54 to cause the valve member 38 to close the valve seat 20 while opening the valve seat 19 and cause the valve member 39 to close the valve seat 18.

In this manner, pressure from the inlet conduit 22 is now directed through the open valve seat 19, chamber 29 and conduit 25 to the inlet side 27 of the coil 14 so that the coil 14 now acts as a condenser to heat the building containing the same whereas the coil 15 now acts as an evaporator so that the expanded refrigerant in the coil 15 can be directed through the conduit 26, chamber 30, open valve seat 21, chamber 36 and return conduits 32 and 31 to the intake side 37 of the compressor 12.

As previously stated, one of the features of the reversing valve construction 10 of this invention is to sequentially close the valve seats 18 and 20 upon a change to the heating cycle as well as to sequentially close the valve seats 19 and 21 upon a reversing of the valve construction 10 from the heating mode to its cooling mode because it is well known that lack of ideal manufacturing tolerances causes leakage problems when two valve members are to simultaneously close two valve seats.

This sequential closing is accomplished in the valve construction 10 of this invention because it can be seen in FIG. 2 that when the flexible diaphragm 44 is being moved to the left, the push rod 58 seats the valve member 38 against the valve seat 19 to close the valve seat 19 before the valve member 40 is seated against the valve seat 21 whereby the outer peripheral portion 78 of the flexible diaphragm 44 further flexes to the left as illustrated in FIG. 2 to further move the valve member 40 to left into its sealing closed position with the valve seat 21 whereby it can be seen that the closing of the ball valve member 38 against the valve seat 19 does not dictate that the valve member 40 must also be simultaneously closed with its valve seat 21 as in the prior art. Thus, fluid leakage at the valve seats 19 and 21 is held to a minimum.

Similarly, when the valve construction 10 is set for its heating cycle as illustrated in FIG. 3, the push rod 57 first seats the ball valve member 38 against the valve seat 20 before the valve member 39 is seated against the valve seat 18 so that the outer peripheral part 79 of the flexible diaphragm 43 further moves to the right as illustrated in FIG. 3 to seat the valve member 39 against the valve seat 18 after the ball valve member 38 has been seated against the valve seat 20. Thus, fluid leakage at the valve seats 20 and 18 is held to a minimum.

Accordingly, it can be seen that a single movable part 43 or 44 is adapted to move two valve members 38, 39 or 38, 40 sequentially to their closed positions to minimize valve leakage during a reversing operation of the valve construction 10 in the refrigerant system 11.

Since the coaxial pistons 53, 55 or 56, 54 are limited in their relative positions by the stops created by the valve seats 20, 18 or 19, 21, the entire area of the coaxial pistons 53, 55 or 54, 56 is available to transfer the ball valve member 38 of the valve construction 10 and only after the ball valve 38 has seated do the coaxial pistons 53, 55 or 54, 56 developed a lower force to seat their respective valve member 39 or 40. In this manner, a force schedule can be derived using various areas for the ball valve ports, piston valve ports and inner and outer coaxial pistons. Since the major forces to move the valve members are due to the diaphragm seal friction and the unbalanced area of the ports, the areas can be selected to provide the maximum forces to unseat the ball valve 38 and move the diaphragm seals 43 and 44.

Thus, it can be seen that this invention provides an improved reversing valve construction.

While the form of the invention now preferred has been illustrated and described as required by the Patent Statute, it is to be understood that other forms can be utilized and still fall within the scope of the appended claims.

What is claimed is:

1. In a reversing valve construction having a housing means provided with a pair of valve seats and a pair of valve members for respectively opening and closing said valve seats, a single pneumatically operated movable part carried by said housing means and being operatively associated with said valve members for sequentially moving the same to their closed positions against their respective valve seats when said movable part is moved in one direction a certain amount, said movable part comprising a flexible diaphragm, said pair of valve seats being in aligned relation, said valve members being in aligned relation and each including a piston portion disposed in engagement with said flexible diaphragm, the improvement wherein said diaphragm causes relative movement between said piston portions to provide for said sequential closing of said valve seats.

2. A reversing valve construction as set forth in claim 1 wherein said piston portions are coaxially aligned.

3. A reversing valve construction as set forth in claim 2 wherein one of said piston portions has an opening means passing therethrough, the other of said piston portions having a part thereof disposed through said opening means and being movable therein to provide for said sequential closing of said valve seats.

4. A reversing valve construction comprising a housing means provided with four aligned valve seats, a first movable valve member disposed between the two intermediate valve seats, second and third movable valve members respectively disposed outboard of the outboard valve seats, a first pneumatically operated movable part carried by said housing means and being operatively associated with said first and second valve members for sequentially moving the same to close one of said two intermediate valve seats and one of said outboard valve seats when said first part is moved in one direction a certain amount, and a second pneumatically operated movable part carried by said housing means and being operatively associated with said first and third valve members for sequentially moving the same to close the other of said two intermediate valve seats and the other of said outboard valve seats when said second part is moved in a direction opposite to said one direction a certain amount, said first valve member having a pair of piston portions respectively disposed in engagement with said first and second parts to be respectively moved thereby, said second and third valve members respectively having piston portions respectively disposed in engagement with said first and second parts to be respectively moved thereby.

5. A reversing valve construction as set forth in claim 4 wherein said pair of piston portions are respectively coaxially aligned with said piston portions of said second and third valve members.

6. A reversing valve construction as set forth in claim 5 wherein said pair of piston portions respectively extend through said outboard valve seats to respectively engage said first valve member.

7. A reversing valve construction as set forth in claim 6 wherein said first valve member comprises a ball.

* * * * *